US011118351B1

(12) United States Patent
Jarmillo

(10) Patent No.: US 11,118,351 B1
(45) Date of Patent: Sep. 14, 2021

(54) RAPID TRUSS SYSTEM

(71) Applicant: Concept Clean Energy, LLC, Laguna beach, CA (US)

(72) Inventor: Elliot Jarmillo, Laguna beach, CA (US)

(73) Assignee: Concept Clean Energy, LLC, Laguna Beach, CA (US)

( * ) Notice: Subject to any disclaimer, the term of this patent is extended or adjusted under 35 U.S.C. 154(b) by 0 days.

(21) Appl. No.: 16/237,574

(22) Filed: Dec. 31, 2018

Related U.S. Application Data

(60) Provisional application No. 62/612,541, filed on Dec. 31, 2017.

(51) Int. Cl.
*E04C 3/02* (2006.01)

(52) U.S. Cl.
CPC ..... *E04C 3/02* (2013.01)

(58) Field of Classification Search
CPC ..... E04C 3/02; E04C 2003/0417
See application file for complete search history.

(56) References Cited

U.S. PATENT DOCUMENTS 4,601,152 A * 7/1986 Coppa ..... E04C 3/02 403/187
4,644,628 A * 2/1987 Coppa ..... E04C 3/02 29/429
6,026,626 A * 2/2000 Fisher ..... E04C 3/08 52/28
6,082,068 A * 7/2000 Fisher ..... E04C 3/08 211/182
6,672,792 B1 * 1/2004 Schipani ..... F16B 7/042 285/320
7,197,856 B2 * 4/2007 Coles ..... E04C 3/005 52/638
7,347,030 B2 * 3/2008 Lewison ..... E04C 3/02 52/648.1
10,801,204 B2 * 10/2020 Chizek ..... E04C 3/11
2004/0123549 A1 * 7/2004 Coles ..... E04C 3/28 52/633
2004/0144055 A1 * 7/2004 Lewison ..... E04C 3/02 52/633
2013/0055656 A1 * 3/2013 Grabow ..... E04B 1/26 52/94
2018/0023309 A1 * 1/2018 Brawner ..... E04B 1/26 52/745.06
2019/0345716 A1 * 11/2019 Chizek ..... E04C 3/29

* cited by examiner

*Primary Examiner* — Rodney Mintz
(74) *Attorney, Agent, or Firm* — FisherBroyles, LLP

(57) ABSTRACT

A system, kit, and method of providing a truss assembly is shown and described.

17 Claims, 3 Drawing Sheets

RAPID TRUSS SYSTEM

This application claims the benefit of U.S. Provisional Application No. 62/612,541 filed Dec. 31, 2017 entitled Rapid Truss System and Method.

Trusses are widely used to create free span architectural features In architecture and structural engineering, a space frame or space structure is a rigid, lightweight, truss-like structure constructed from interlocking struts in a geometric pattern. Trusses can be used to span large areas with few interior supports. The truss is strong because of the inherent rigidity of the triangle whereby flexing loads are transmitted as tension and compression loads along the length of each strut. Today's steel and aluminum trusses provide great freedom of expression and composition as well as the possibility to evenly distribute loads along each rod and external constraints. With these features, trusses can be used to achieve complex geometries with a structural weight lower than any other solution.

A typical two dimensional truss is comprised of two rails and triangular "struts" situated on the same plane. A typical three dimensional truss is composed of three rails and an internal triangle "strut" system. Existing Trusses employ a variety of metals that require fixed connections or welds at each of the strut and rail connection points. This creates a considerable amount of labor required to cut, weld, drill or otherwise create brackets or fixtures to fix the connection points so they do not move. In many cases, trusses are built to specification at a remote site and shipped to the location where they will be used. Shipping full truss assemblies is inefficient in both the time lead needed for fabrication and delivery, as well as in space utilization because assembled trusses are bulky and require an area significantly greater than would be needed for just the component parts.

Currently no system or method exists that will allow for rapid assembly of trusses, including efficient manufacturing, shipping and assembly in the field without the need for welding, solvent application or bolts.

BRIEF DESCRIPTION OF DRAWINGS

The accompanying drawings, which are incorporated in and constitute a part of the specification, illustrate various example systems, methods, and so on that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an external component and vice versa. Furthermore, elements may not be drawn to scale.

DETAILED DESCRIPTION

Figure 2:
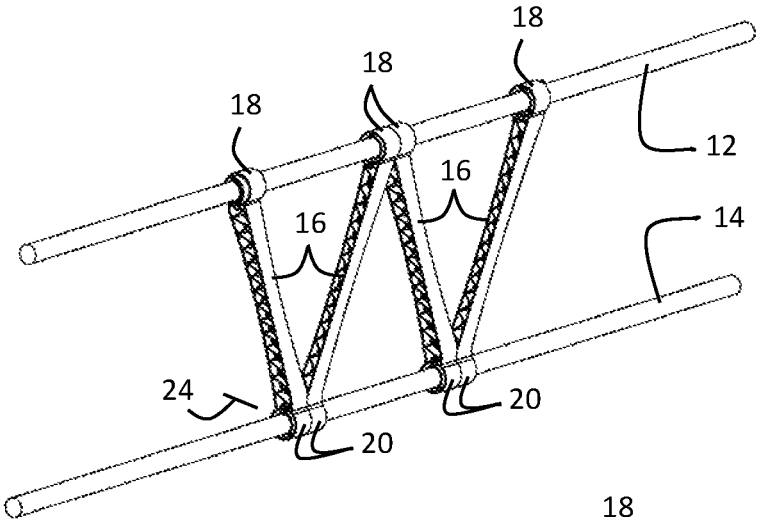
FIG. 2 is a simplified view of a two-dimensional truss in a state nearing final assembly, according to one aspect of the disclosure.

The disclosure can be understood more readily by reference to the following detailed description, examples, and claims, and their previous and following description. Before the present system, devices, and/or methods are disclosed and described, it is to be understood that the invention is not limited to the specific systems, devices, and/or methods disclosed, as such can, of course, vary. It is also to be understood that the terminology used herein is for the purpose of describing particular aspects only and is not intended to be limiting.

Those skilled in the relevant art will recognize that many changes can be made to the several aspects described, while still obtaining the beneficial results shown and described. It will also be apparent that some of the desired benefits can be obtained by selecting some of the features without utilizing other features. Accordingly, those who work in the art will recognize that many modifications and adaptations are possible and can even be desirable in certain circumstances and are a part of the present disclosure. Thus, the following description is provided as illustrative of certain principles and not in limitation thereof.

As used herein, the singular forms "a," "an" and "the" include plural referents unless the context clearly dictates otherwise. Thus, for example, reference to an "orifice" includes aspects having two or more orifices unless the context clearly indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Terms used herein, such as "exemplary" or "exemplified," are not meant to show preference, but rather to explain that the aspect discussed thereafter is merely one example of the aspect presented.

Additionally, as used herein, relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

As used herein, "connection" or "connected" means both directly, that is, without other intervening elements or components, and indirectly, that is, with another component or components arranged between the items identified or described as being connected. To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the claims (e.g., A or B) it is intended to mean "A or B or both." When the applicants intend to indicate "only A or B but not both" then the term "only A or B but not both" will be employed. Similarly, when the applicants intend to indicate "one and only one" of A, B or C, the applicants will employ the phrase "one and only one." Thus, use of the term "or" herein is the inclusive, and not the exclusive use. See, Bryan A. Garner, A Dictionary of Modern Legal Usage 624 (2d. Ed. 1995). To the extent that the phrase "one or more of A, B and C" is employed herein, (e.g., storage for one or more of A, B and C) it is intended to convey the set of possibilities A, B, C, AB, AC, BC, and/or ABC (e.g., the storage may store only A, only B, only C, A&B, A&C, B&C, and/or A&B&C). It is not intended to require one of A, one of B, and one of C. When the applicants intend to indicate "at least one of A, at least one of B, and at least one of C," then the phrasing "at least one of A, at least one of B, and at least one of C" will be employed.

Figure 1:
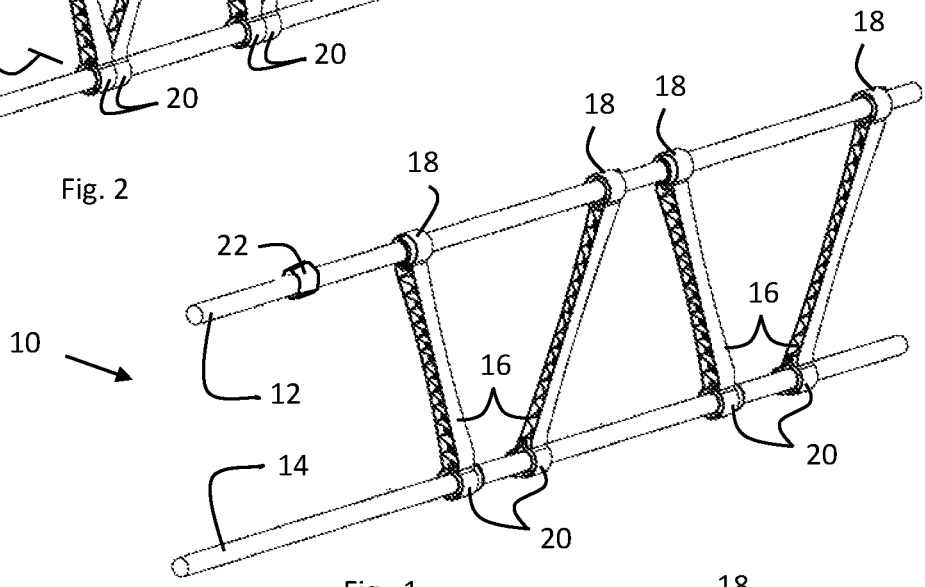
FIG. 1 is a simplified view of a two-dimensional truss in a state of intermediate assembly, according to one aspect of the disclosure.

With reference now to FIGS. 1 and 2, an exemplary two-dimensional truss 10 is illustrated. The truss 10 includes two rails 12, 14 spaced and held approximately parallel by a series of reversible two-dimensional struts 16. As further discussed below, each strut 16 may be identical to facilitate manufacturing and merely disposed in a one "forward," one "backward" alternating arrangement on the rails to form a series of triangles. One rail, 12 passes through shaped openings in a head portion 18 of the rail while the other rail, 14 passes through shaped openings in an opposed head portion 20 of the rail. While the rails 12, 14 and head portions 18, 20 are illustrated as circular, in other embodiments, other rails and head portions may be shaped differently but complementarily. In one embodiment, the struts 16 are urged together by a user so that adjacent head portions 18 on the one hand, and adjacent opposed head portions 20 on the other hand, connect or otherwise engage as seen best in FIG. 2. Once head portions 18, 20 are engaged, a user may fix the truss by moving a cap 22 into contact with one or more of the un-connected head portions 18, 20 and fixing it in place. Alternately, or additionally, a user may set a stop 24, such as a screw, pin, bolt or the like through at least one head portion 18, 20 into contact with an external side of the respective rail 12, 14 or alternately through the respective rail 12, 14 and perhaps also through an opposed side of the head portion.

Figure 3:
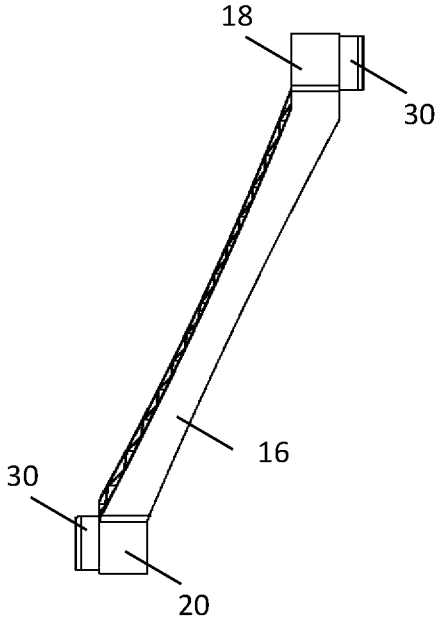
FIG. 3 is a side view of a two-dimensional truss strut, according to one aspect of the disclosure.

With reference now to FIG. 3, an exemplary strut 16 is shown. As can be seen, opposed head portions 18, 20 are offset modestly by an angle of the strut while the head portions 18, 20 themselves are disposed such that respective shaped openings (see, FIG. 4 ref 36A) lie in a parallel orientation. Additionally, head portions 18, 20 may include a connecting flange 30 to be received in a complementary space on an adjacent head portion when urged into contact by a user.

Figure 4:
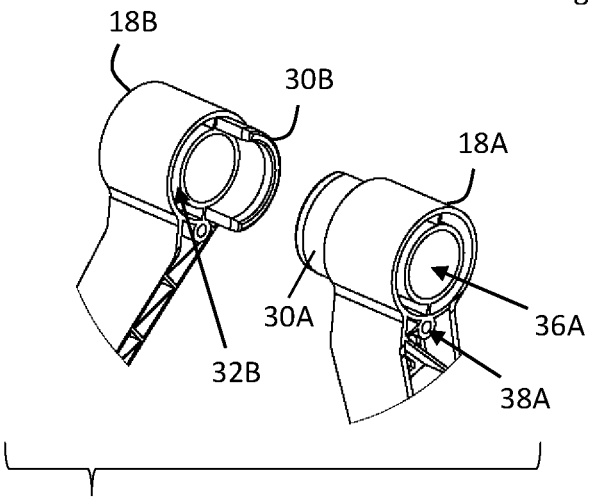
FIG. 4 is an enlarged view of corresponding head portions of two-dimensional truss struts, according to one aspect of the disclosure.

For example, and referring to FIG. 4, each head portion includes a flange 30 and a complementary space 32. In this embodiment, a user will urge flange 30A into space 32B, while at the same time flange 30B is urged into complementary space 32A (not shown). Optionally, the user may affix the head portions 18A and 18B together with a screw (not shown) tapped into screw hole 38A and a corresponding location on head portion 18B. In other embodiments, adjacent head portions may be affixed with a snap lock, hook and groove or other arrangement instead of the flange/space and screw arrangement described. In still other embodiments, the head portions 18, 20 may not include any interlock for the head portions substituting instead a flush surface connection between adjacent head portions.

In practice, a number of identical struts are manufactured and packed compactly for delivery to and assembly at a location where a truss is desired. Various different struts can provide variation in strength, truss size, particular rail size and the like. In one embodiment, struts, end caps and connectors (screws, pins, etc) are shipped to the location. Off the shelf stock sized tubing, I-beams or the like are purchased near the desired location reducing shipping costs and lead time needed to begin truss assembly and use. Desired size, shape and strength trusses can be quickly formed on location and put into use immediately. Further, unlike welded or other more permanent trusses, the truss may also be quickly disassembled and moved compactly to a new location or to a new use. While the rails may be moved as well, it may be economical to abandon, sell or recycle them and purchase new rails near the new location.

Figure 5:
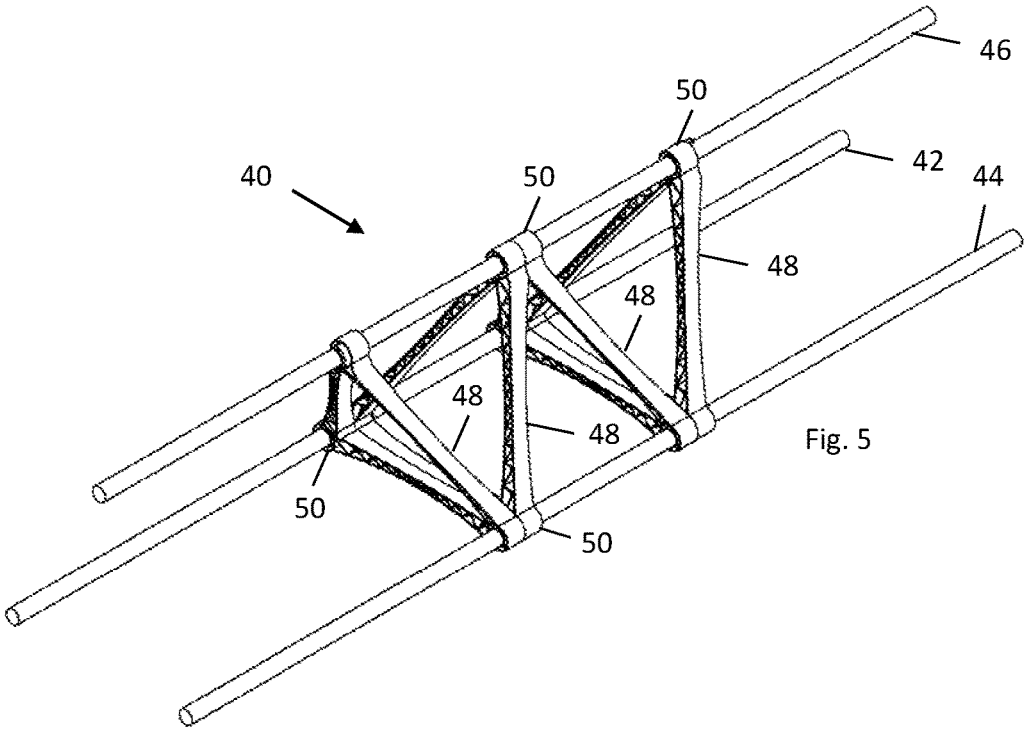
FIG. 5 is a simplified view of a three-dimensional truss, according to one aspect of the disclosure.

With reference now to FIG. 5, an exemplary three-dimensional truss 40 is shown. The truss 40 includes three rails 42, 44, 46 spaced and held approximately parallel by a series of reversible three-dimensional struts 48. Each strut 48 is preferably identical to the others to facilitate manufacturing and to permit an alternating arrangement on the rails to form a series of roughly equal geometric shapes. Each rail 42, 44, 46 passes through shaped openings in a head portion at a vertex 50 of respective vertices of the strut while other rails pass through shaped openings at other vertices 50 of each strut 48. To be certain, as illustrated the rails 42, 44, 46 and vertices 50 are illustrated in FIG. 5 as circular, in other embodiments, other rails, head portions and vertices may be shaped differently but complementarily.

In one embodiment, the struts 48 are urged together along the rails by a user so that adjacent vertices 50 along each rail connect or otherwise engage as described and shown. Once adjacent vertices 50 are engaged, a user may fix the truss by moving a cap 22 (see e.g. FIG. 1) into contact with one or more of the end vertices 50 and fixing it in place. Alternately, or additionally, a user may set a stop 24 (see e.g. FIG. 2), such as a screw, pin, bolt or the like through at least one vertex 50 into contact with an external side of the respective rail or alternately through the respective rail and perhaps also through an opposed side of the vertex.

Figure 6:
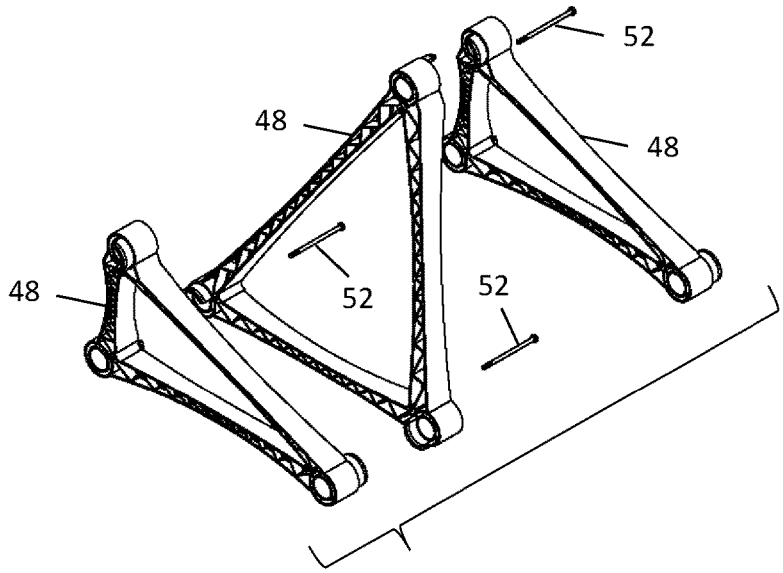
FIG. 6 is an arrangement of reversible truss struts for a three-dimensional truss, according to one aspect of the disclosure.

With reference now to FIG. 6, optionally, the user may connect adjacent vertices 50 together with a screw 52 tapped into screw hole (not shown) with a corresponding location of an adjacent vertex. In other embodiments, adjacent vertices may be affixed with a snap lock, hook and groove or other arrangement instead of the flange/space and screw arrangement described. In still other embodiments, the vertices 50 may not include any interlock substituting instead a flush surface connection between adjacent ones. It can be appreciated that in the illustrated arrangement, the struts 48 have at least one, but less than all, vertices in a contacting arrangement; whereas the struts 48 may alternately be compactly arranged, for example when in shipment, to have all vertices in contact. Similar dual alternating arrangements—i.e. aligned, compact shipping in a first arrangement and opposed, spread second arrangement for deployment or use—may be obtained regardless of the number of head portions or vertices in a strut.

Figure 7:
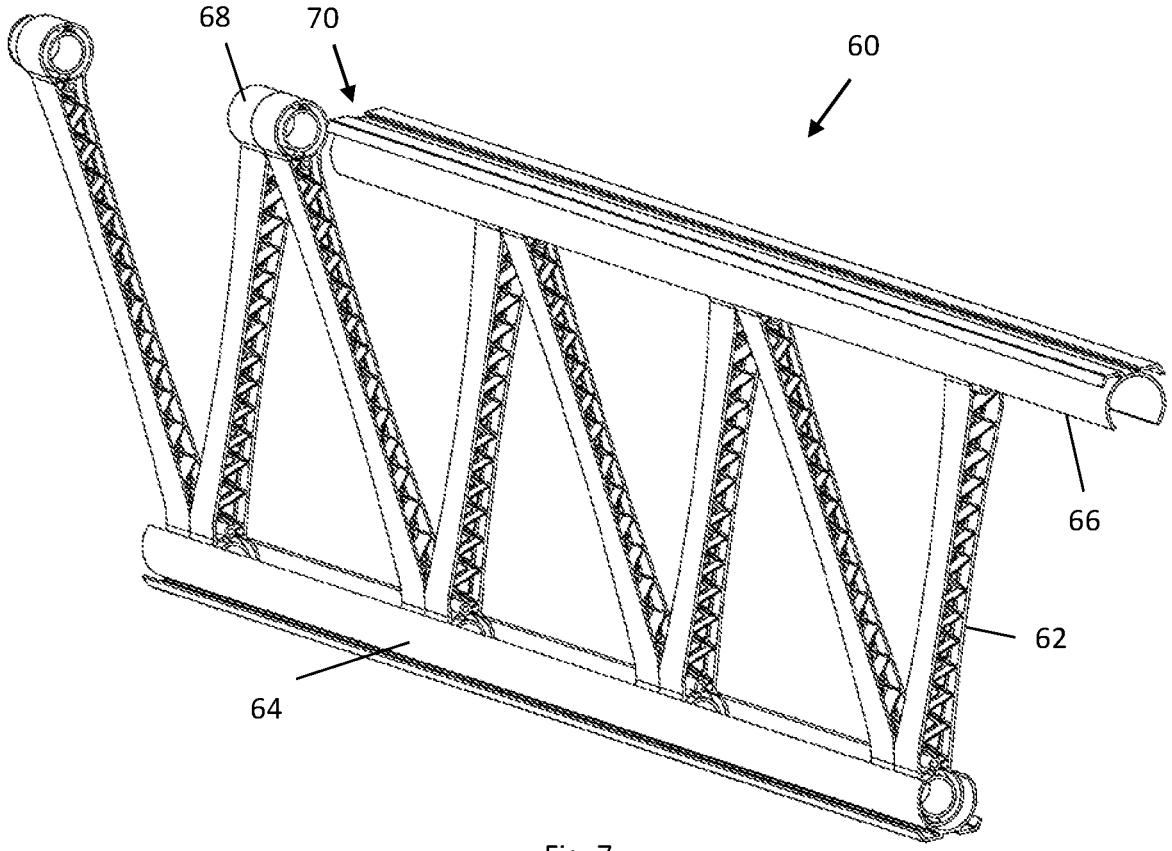
FIG. 7 is simplified view of a two-dimensional truss, according to one aspect of the disclosure.

With reference now to FIG. 7, an exemplary two-dimensional truss 60 is shown although the concepts are amenable to a three-dimensional or larger dimensional assembly. The truss 60 includes fabrication, delivery and assembly concepts describe in connection with other embodiments disclosed or as would be understood by an artisan. A set of reversible struts, 62 are connectable together at end points (not shown) and support opposed slide rails 64, 66 in a substantially parallel configuration. In one embodiment, the slide rails 64, 66 engage with and lie external to head portions 68 of the struts 62. The slide rails may include a longitudinal channel 70 or other connection means for attaching items to the assembled truss 60. In one embodiment, the attached items may include solar panels, electrical connection points and the like. Additionally, the attached items may include lifting or connection hard points to other structural features. In yet other embodiments, conventional tube or off the shelf rails as described may be used to further provide structural support to the truss 60. In still other embodiments, the head portions may be shaped, solid or in other configurations but capable of connecting to slide rails.

The concepts disclosed are, in part, unique and non-obvious because no other fastening, welding or locking mechanisms are required once the truss is assembled. At the end of the desired span, the end struts are clamped in place or otherwise secured from movement. The result is that internal struts are held in place, for example, via compression, resulting in a fully assembled truss configuration that is both stable and strong. In embodiments, the snap lock or variously described connection features at the ends of the truss and/or any bolts that may be added are simply to enhance the structural integrity and to facilitate ease of assembly.

While preferred embodiments have been shown and described herein, it will be obvious to those skilled in the art that such embodiments are provided by way of example only. Numerous variations, changes, and substitutions will now occur to those skilled in the art without departing from the teachings herein. It should be understood that various alternatives to the embodiments described herein may be employed. It is intended that the following claims define the scope of the invention and that methods and structures within the scope of these claims and their equivalents be covered thereby.

What is claimed is:

1. A system for constructing a truss comprising:

a first strut including a head portion having opposed front and rear sides, the head portion integrally connected by an integral neck to an opposed head portion, where the front side includes a periphery around a first shaped opening, the periphery having a flange extending partially around the periphery, and the periphery further having a space configured to closely receive a flange from a front side of a second strut in a first, deployed orientation;

the second strut being identical to the first strut;

at least one terminal piece configured to be connected to a rail in a position contacting either the head portion or the opposed head portion of at least one of the first strut or the second strut;

where in a second, shipping orientation the first strut and the second strut contact:

at the head portions, so that the flange from the front side of the first strut is received in a space on the rear side of the second strut;

along the integral necks; and at the opposed head portions;

where in the first orientation the first strut and the second strut contact at respective head portions or respective opposed head portions but not both.

2. The system as set forth in claim 1, further comprising instructions on rail acquisition including sizing compatible with the struts, where the system is provided as a kit and where the rails are acquired separately from the kit.

3. The system as set forth in claim 1, further comprising instructions on assembling the truss from components including the struts, terminal piece and rail.

4. The system as set forth in claim 1, further comprising supplemental connectors to affix selected head portions to the rail.

5. The system as set forth in claim 1, further comprising connector means for affixing selected head portions to the rail.

6. The system as set forth in claim 1, further comprising instructions on obtaining and using supplemental connectors to affix selected head portions to the rail.

7. The system as set forth in claim 1, further comprising supplemental connectors to affix selected head portions to adjacent head portions.

8. The system as set forth in claim 1, further comprising instructions on obtaining and using supplemental connectors to affix selected head portions to adjacent head portions.

9. The system as set forth in claim 1, further comprising a cap slidable over at least one rail and fixable to the rail in a position connected to an end head portion, thereby holding the struts to a set location relative to the rail.

10. The system as set forth in claim 9, where the cap prevents movement of the connected end head portion along the rail and in turn prevents movement of other head portions along the rail that would otherwise disconnect adjacent head portions.

11. The system as set forth in claim 9 further comprising a mechanical connection between a respective said head portion and a respective said rail preventing movement of the respective head portion along the respective rail.

12. The system as set forth in claim 9 further comprising means for preventing movement of connected head portions along the rail.

13. The system as set forth in claim 9, where the head portions comprise an internal opening bounded by a periphery wherein the rails pass through the internal opening and contact the periphery.

14. The system as set forth in claim 9, where the rails comprise a longitudinal channel bounded by a periphery wherein longitudinal channel at least partially surrounds the head portions which contact the periphery of the channel.

15. A method of assembling the system of claim 1 in a location near that of intended use of the truss, the method comprising:

sending a plurality of the identical first and second struts to the location, and the plurality of identical struts are arranged for sending in compact form;

providing instructions on commercially available rails to be obtained on or near the location, including rails compatibility with the head portions of the plurality of struts;

providing instructions on arranging the plurality of struts on the commercially available rails in the deployed orientation such that at least one head portion is spaced from and not in contact with a corresponding head portion of an adjacent strut; and sending a plurality of the terminal pieces connectable to the commercially available rails, where the terminal pieces connect to the rail and an end head portion, thereby holding the struts immovable along the rail.

16. The method as set forth in claim 15, further comprising providing instructions to affix selected head portions to the rail.

17. The method as set forth in claim 15, further comprising providing instructions to affix selected head portions to adjacent head portions.

* * * * *